356-400 SR
XR 3,987,964

United State
Pittman et al.

[11] 3,987,964
[45] Oct. 26, 1976

[54] MOBILE HYDRAULIC JETTING DEVICE FOR CLEANING LARGE PLANAR SURFACES

[75] Inventors: Forrest Pittman; Robert Q. Shelton, both of Duncan, Okla.; Marvin L. Klein, Wichita, Kans.; Carlos E. Gutierrez, Harvey, La.; William F. White, Jackson, Miss.

[73] Assignee: Halliburton Company, Duncan, Okla.

[22] Filed: June 29, 1973

[21] Appl. No.: 374,842

[52] U.S. Cl. ..... 239/169; 134/34; 239/287; 239/550; 356/172
[51] Int. Cl.[2] ..... B05B 1/14
[58] Field of Search ..... 239/550, 551, 552, 287, 239/172, 176, 169; 134/34; 356/172

[56] References Cited

UNITED STATES PATENTS

| | | | |
|---|---|---|---|
| 2,152,407 | 3/1939 | Fawley | 239/550 |
| 2,579,792 | 12/1951 | Cartwright | 239/551 |
| 3,690,559 | 9/1972 | Rudloff | 239/550 X |
| 3,709,436 | 1/1973 | Foster | 239/550 X |
| 3,726,481 | 4/1973 | Foster et al. | 239/287 |
| 3,813,171 | 5/1974 | Teach et al. | 356/172 X |

OTHER PUBLICATIONS

Construction Engineering, "Laser Automatically Operates Earth-Moving Equipment", Dec. 1970, vol. 17, No. 12, p. 42.

Measurement & Control, "Optical Guidance of Vehicles", Mar. 1964, pp. 97 & 98.

*Primary Examiner*—Robert S. Ward, Jr.
*Assistant Examiner*—Michael Mar
*Attorney, Agent, or Firm*—John H. Tregoning; Bruce E. Burdick

[57] ABSTRACT

An apparatus for rapid removal of rubber, paint, oil and other contaminants from large planar surfaces by high pressure jetting through a mobile pattern of fantail nozzles. One embodiment utilizes a laser beam system to guide a mobile pattern of nozzles along a planar surface. Another embodiment utilizes a spray bar horizontally angled to a supporting vehicle. Another embodiment utilizes a protractor to measure the vertical attack angle between a mobile spray pattern and a planar surface.

22 Claims, 12 Drawing Figures

3987964

MOBILE HYDRAULIC JETTING DEVICE FOR CLEANING LARGE PLANAR SURFACES

BACKGROUND OF THE INVENTION

Concrete and asphaltic surfaces such as airport runways and automobile highways, and particularly concrete airport runways, often collect a mixed residue of rubber particles marking paints, oil drippings, dirt, and other undesirable contaminants.

Airport runways are particularly susceptible to this phenomenon because of the violence with which rubber tired aircraft landing gear make contact with runway surfaces, which contact results in heavy deposits of rubber from the tires of the aircraft. In addition, runways carry extensive painted markings thereon to guide pilots in landing and taxiing in and to the proper areas. These painted markings eventually weather, crack, and peel to the extent that they may become difficult or impossible to read clearly, plus they further add to the deposits of contaminants. Other contaminants include the droppings of oil and spilled fuel on the runways both from the aircraft and from ground vehicles used in refueling and maintenance of the aircraft.

The results of these factors are twofold. First, the peeling of painted markings, plus the deposition of rubber and other substances over the non-peeled remainder of the markings results in obliterating the vital runway markings which creates a very dangerous situation with respect to aircraft landing and taking off.

A second undesirable effect of the substances deposited on the runways is the resultant loss of traction between the landing gear and the surface of the runway. This is a particularly hazardous situation when huge jet aircraft are landing at night on a rain or snow wetted runway. The mixture of natural precipitation on a rubbery, oily surface serves as a very efficient lubricant between the landing wheels and the runway and prevents, in many cases, the stopping of the aircraft within a safe distance. Add to this the effect that because of the night, the partially obliterated markings, and the weather, the pilot may not be able to set the aircraft down in a position to utilize the maximum length of the runway. In that situation braking ability is critical.

One solution to the painted marking obliteration problem is to entirely remove the obliterated markings from the runway surface and repaint the markings afresh. One solution to the loss of traction is similar; the contaminants must be removed.

In the past this has involved a messy and time consuming process of spraying chemical solvents on the runways in order to dissolve the rubber, oils, fuels, and paints thereon, allowing the solvent to work for a sufficient time, and then flushing the surface with a washing solution.

This process is basically undesirable for two reasons. The first is the time element involved. For instance, Chicago's O'Hare field could not afford to close down a busy runway for the one or more days required to perform the above chemical process because it would place an unbearable overload on the remaining runways, causing extremely hazardous air traffic congestion.

The second problem is that of ecological pollution. The dissolved contaminants, the solvents, and the washing solution which run off the runway eventually find their way into streams, lakes, and municipal water supplies. These solvents and the reaction products therefrom are noxious and even poisonous and therefore it is mandatory that they be prevented from entering any body of water.

One method that has been used in the past to clean these surfaces without the use of solvent has been to utilize hand-carried lances to apply streams of high pressure water to the contaminants to jet-blast them from the surface. While this has partially solved the ecological problem, it has only worsened the time factor since the hand-lancing technique is even more time consuming than the solvent method.

The present invention overcomes these problems by providing apparatus which can quickly and efficiently apply a broad pattern of high pressure water or neutral-fluid spray to the surface to be cleaned in a fast moving, broad sweeping cleaning action, which apparatus can almost instantly be temporarily removed from the surface being cleaned in case an emergency need for the runway or roadway arises. The apparatus also provides extremely swift yet effective means of removing deposits from the desired surfaces without harming these surfaces.

DESCRIPTION OF THE PREFERRED EMBODIMENTS

Figure 1:
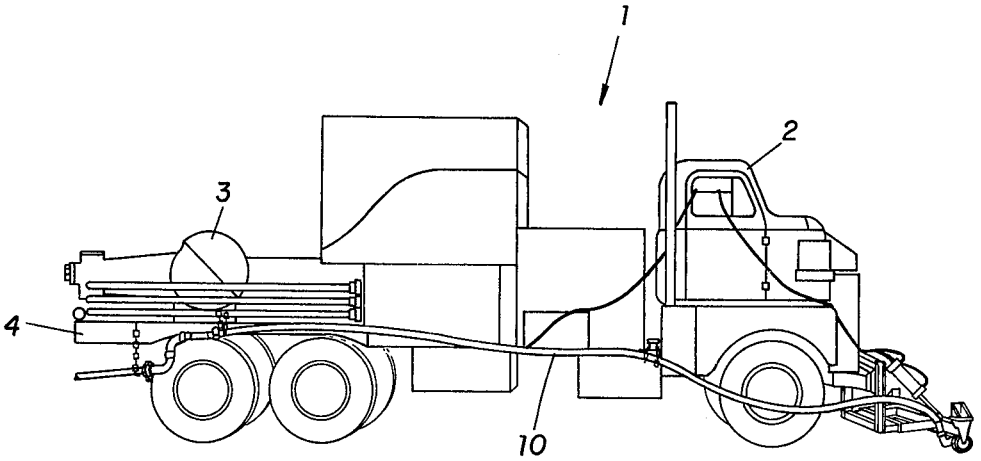
FIG. 1 illustrates a side view of the hydraulic blast cleaning system.
Figure 2:
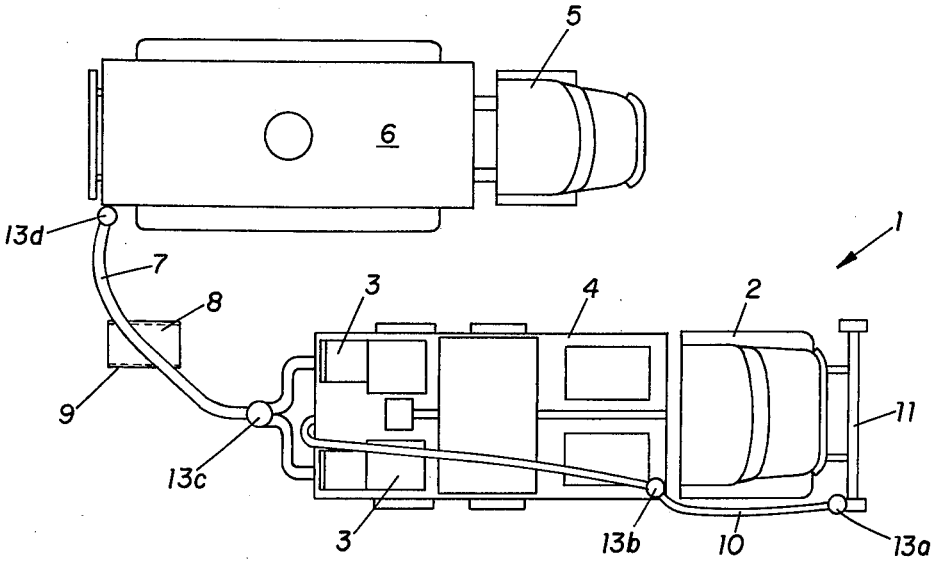
FIG. 2 is a top view of the system.

Referring to FIGS. 1 and 2, the hydraulic blasting assembly 1 is shown comprising a truck 2 moving a high pressure water supply system including one or more high intensity pumps 3 mounted on a truck bed or trailer 4. Water or some other neutral fluid is carried in supply tank truck 5 moving alongside or to the rear of the spray truck 2. Tank truck 5 contains a high volume fluid storage and supply capacity in tank battery 6 located thereon, which fluid supply is connected to the spray truck by flexible conduit 7.

In order to allow a safe distance between the spray truck system 2 and the liquid supply system 5 a relatively long length of conduit 7 may be utilized. To prevent abrasion of the conduit as the entire assembly moves down the runway or roadway, a support dolly 8 having wheels 9 located thereunder may be fixedly attached under the drooping section of flexible conduit 7.

Conduit 7 passes from tank battery 6 to the pumps 3 and from the pumps into high pressure conduit 10 whereby it is passed to the front of the spray truck 2. Conduit 10 fluidically communicates with the spray bar manifold 11 movably attached to the front of truck 2.

Manifold 11 consists of a high pressure tubular member passing substantially across the front of truck 2 and having one end connected to high pressure supply conduit 10 and the opposite end is capped or plugged.

Figure 3:
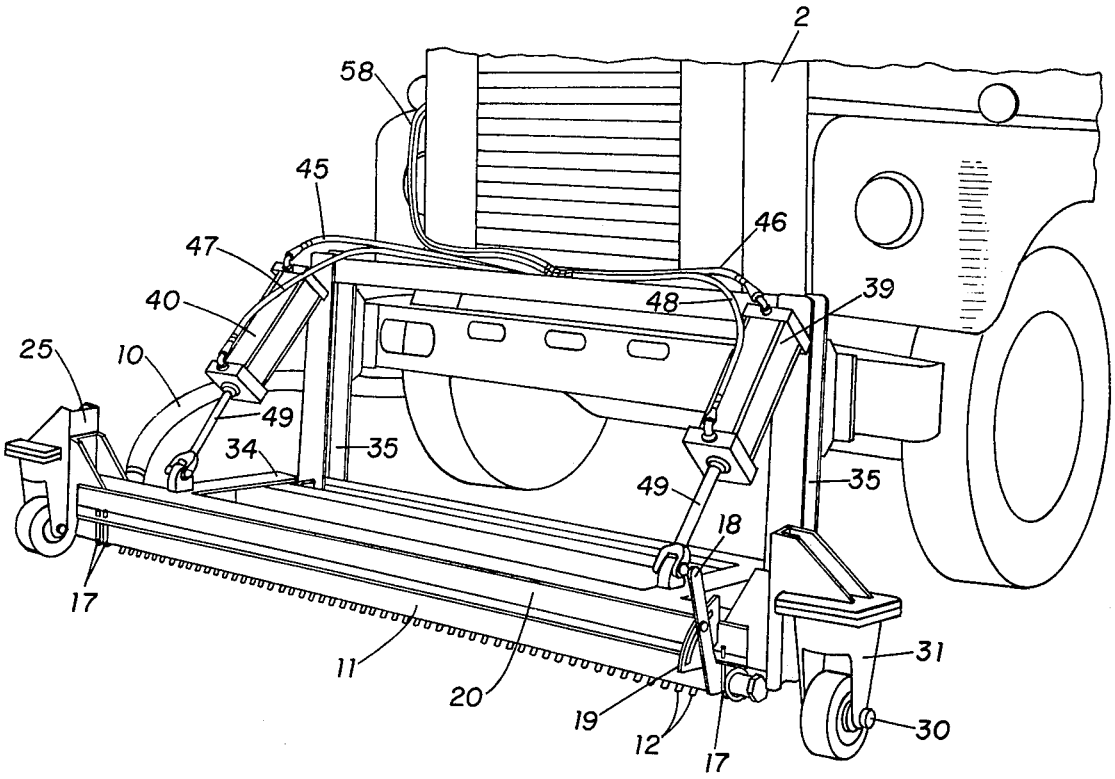
FIG. 3 is an isometric illustration of the spray system.

Referring to FIG. 3, threadedly engaged in manifold 11 and fluidically communicating with the inner bore of manifold 11 is a plurality of spray nozzles 12 pointing in a generally forward and downward direction.

Figure 8:
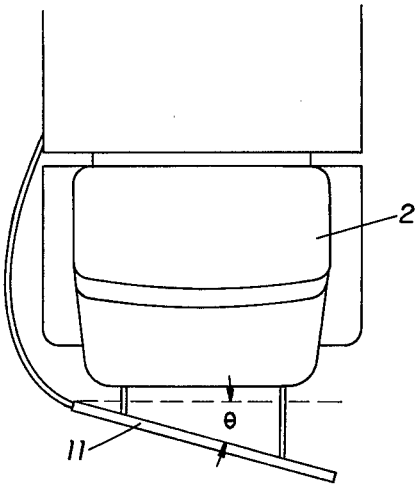
FIGS. 8 and 8*a* show alternate spray bar configurations.
Figure 8A:
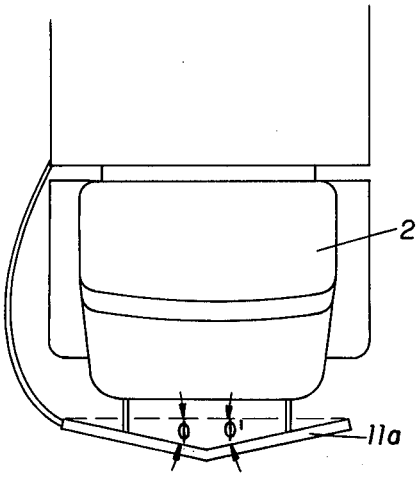

FIGS. 2, 8, and 8*a* illustrate several possible configurations for manifold 11. In FIG. 2 manifold 11 is illustrated as a straight tubular section extending across the front of truck 2 and parallel to the front of the truck.

FIGS. 8 and 8*a* illustrate alternate configurations of the spray assembly having a vee shaped tubular manifold 11*a* extending across the front of the truck and having included angles of $\phi$ and $\phi'$, or a straight manifold 11 extending across at an angle $\theta$ to the front of the truck.

Various valves 13*a*, 13*b*, 13*c*, and 13*d* may be placed at different points in the fluid supply conduits 7 and 10 to allow flexible control over the fluid supply. These may be either manually operable, automatically actuated, or a combination of both.

Figure 6:
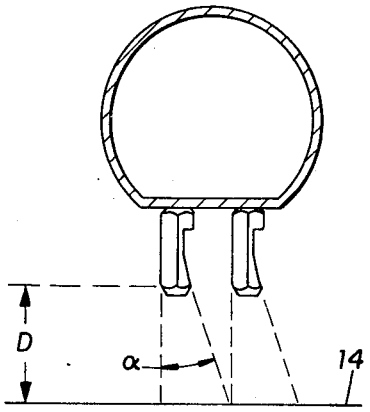
FIGS. 6, 6*a*, and 6*b* illustrate nozzle placement.

In FIG. 6 the spray manifold 11 is shown with relation to the surface being cleaned 14. The distance D represents the "standoff" distance of the measured vertical heighth of the spray nozzle tip 15 from the surface being cleaned. Also evident in FIG. 6 is the angle of spray impingement on surface 14 which angle is indicated by the symbol $\alpha$ and is measured from the vertical. The spray nozzles preferably emit a flat spray pattern directed forwardly of the truck to blast the residue away from the front of the truck where conventional vacuuming devices can effectively pick up the loose material.

The standoff distance D should preferably be anywhere from about ¼ inch up to about 6 inches with an optimum range of about ½ to 2 inches. The spray impingement angle should vary from 0° up to about 55° with an optimum angle of around 35°.

The angles of the spray manifold with the front line of the truck should run from about 0° to 55° for $\theta$ and about 10° to 55° for $\phi$ with an optimum angle of about 30° for each, except for one preferred embodiment where $\theta$ is 0°.

The angle $\alpha$ which represents the inclination of the sprayed fluid from the vertical orientation is achieved as a combination of two angles. One is the angle imparted to the spray by the nozzle itself. The second is the angle imparted by rotation of the manifold as described below. More particularly, the first angle arises from the canted orientation of the spray nozzle fan tail with respect to the longitudinal axis (bore axis) of the nozzle. As illustrated in FIG. 6, spray nozzle 12 is preferrably of the "fan-tail" type having a bore along its longitudianl axis, said bore preferrably being of from about 0.010 inches up to about 0.40 inches, and further having a fan-tail portion arranged to alter the direction of spray from said bore, said angle of alteration being from about 5°up to about 45°. In one preferred embodiment, the fluid was sprayed from the nozzles chosen at an angle of about 22° from the bore axis of the nozzle.

This angle is supplemented by rotating the nozzle manifold 11 in its U-brackets 17 by means of handle 18 attached thereto (see FIG. 3). This rotation can be in the direction to increase angle $\alpha$ or can be in the opposite direction to decrease angle $\alpha$. In one preferred embodiment, the manifold 11 was rotated 15° forward to add to the 22° cant of the nozzles and arrive at a total angle of 37° for $\alpha$, which angle appeared to give excellent cleaning results.

Figure 6A:
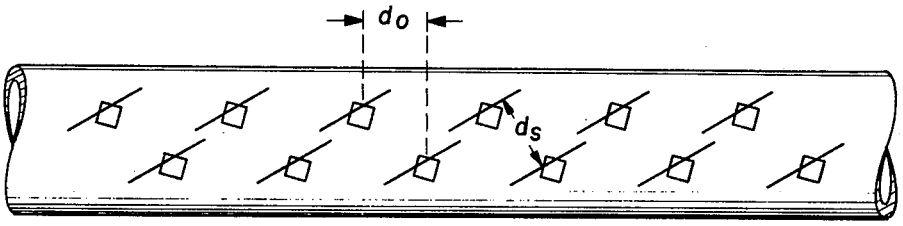
Figure 6B:
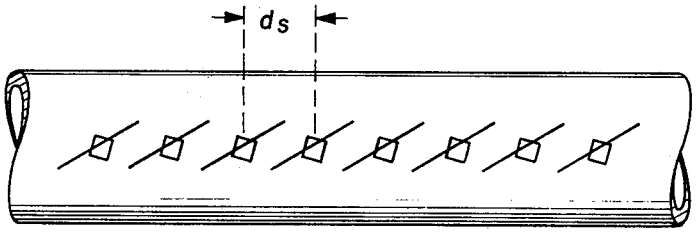

It was found that in order to obtain maximum cleaning area and effect without having unnecessary overlap that a flat spray pattern, as shown in FIGS. 6*a* and 6*b*, was most effective. This tended to maintain a substantially constant energy level across the entire length of each individual spray pattern and maintained a relatively high energy level in the outer fringes of the pattern. Due to the fact that there was a slight drop in spray velocity and energy level near the outer edges of the spray pattern, it was discovered that the optimum arrangement of spray nozzles on manifold 11 resulted from a staggered placement as shown in FIG. 6*a*. This provided a slight overlap of spray patterns which compensated effectively for the slightly lower energy levels in the high pressure fluid near the outermost skirts of the spray patterns. It should be emphasized that for maximum spraying efficiency, the spray patterns should be arranged so as to not intersect one another, which interference of sprays is very destructive to the force of the spray and results in reduced cleaning in the interference area. For example, even when using a straight-line placement of nozzles as shown in FIG. 6*b*, the nozzles should be angled slighted as shown in order to allow overlap of the spray patterns without consequent interference of the patterns at their edges. This angle of the sprays can run from about 5° to about 45° with a preferable angle of about 10° to 15°. This angle further aids in blasting the residue from the surface 14 to the side of the cleaning truck thereby aiding the cleaning process by not having to continuously move forward the accumulated residue and further aids the visibility of the driver.

The staggered arrangement also allows more room between each individual spray nozzle for convenience of attachment and removal of the nozzles to and from the manifold. Due to the physical dimensions of the nozzles and the necessity for maintaining close arrangement of the nozzles to each other, a straight-line placement of them makes application of a wrench on the nozzles difficult; therefore, the staggered placement not only provides ample room to work on the nozzles but also provides as tight a spray pattern as is desired.

Further overlap of the spray patterns in the alternate embodiments of FIGS. 8 and 8*a* can be achieved by increasing the angle $\theta$ or $\phi$ of the spray manifold 11 to the front of the truck 2. Of course, the greater the angle, the more overlap occurs. The maximum overlap of course would occur at angles equaling 90° whereupon all nozzles would emit spray patterns overlapping each other 100 percent. This is an impractical situation since the width of the area cleaned would only be as wide as the spray pattern of one nozzle. Thus, an optimum angle for $\theta$ would be 30° to 45°.

A comparison of nozzle separation distance $d$ is illustrated in FIGS. 6*a* and 6*b*. In the straight-line configuration of 6*b* the minimum acceptable nozzle separation $d_s$ which will still allow a wrench to be applied to the nozzles is around one inch. Using the staggered arrangement of FIG. 6*a*, an effective nozzle separation $d_o$ of 0.75 inches can be obtained, which distance appears to be the optimum for maximum cleaning width and maximum cleaning ability, yet the actual nozzle separation $d_s$ may be over one inch, thereby allowing ample room to apply necessary tools to the spray nozzles.

Figure 5:
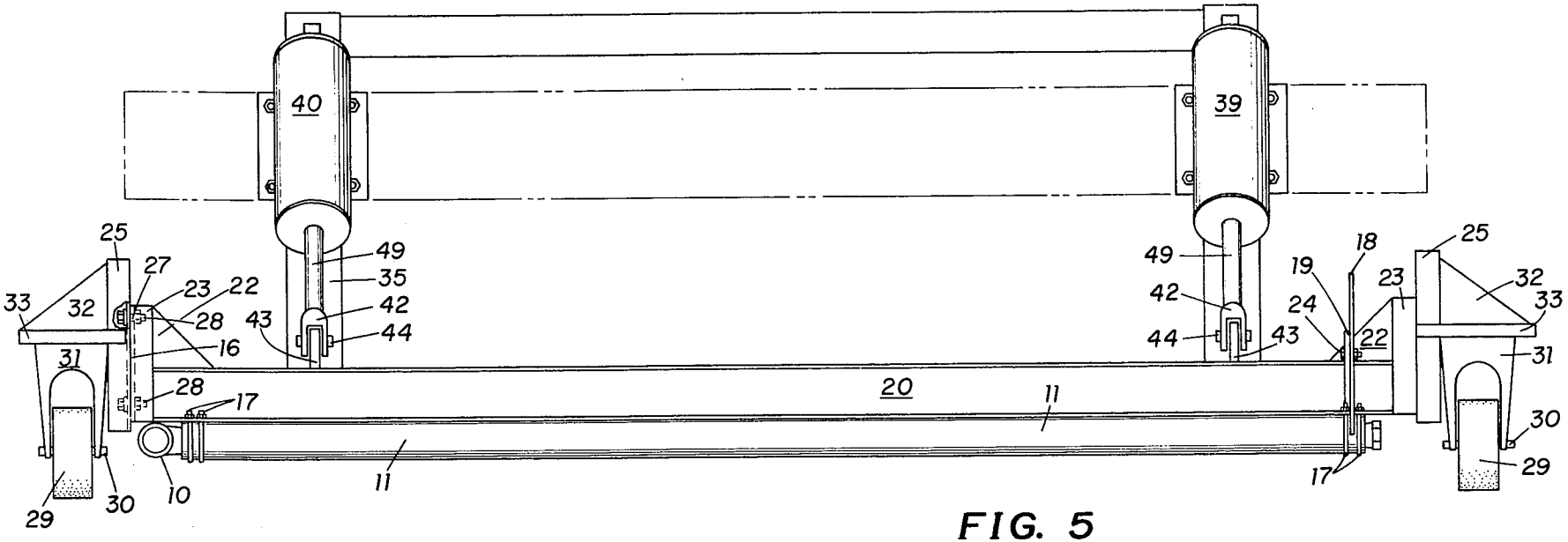
FIG. 5 illustrates the bar assembly from the front view.

FIGS. 3 and 5 clearly illustrate the means for canting the spraying bar 11 to obtain variation of the angle $\alpha$ of the spray to the vertical. The canting means consists of canting handle 18 and protractor scale 19. Handle 18 is fixedly attached to the manifold 11 by convenient attachment means such as welding or bolting. Protractor scale 19 is fixedly attached to stationary manifold support frame 20 which is indirectly fixedly attached to bumper 21 of truck 2. Attachment of manifold 11 to truck 2 is by means of a partially rotatable arrangement consisting of bolting manifold 11 to frame 20 using U-bolt type clamping means 17. U-bolts 17 are only snugged-up and not completely tightened, thereby allowing restricted rotation of manifold 11 through application of sufficient force on handle 18. The friction of the U-bolts on manifold 11 is sufficient to prevent unwanted rotation during normal use. Alternatively U-bolts 22 can be tightened completely for operation and afterwards loosened when it becomes desirable to change the cant angle, $\alpha$.

Figure 4:
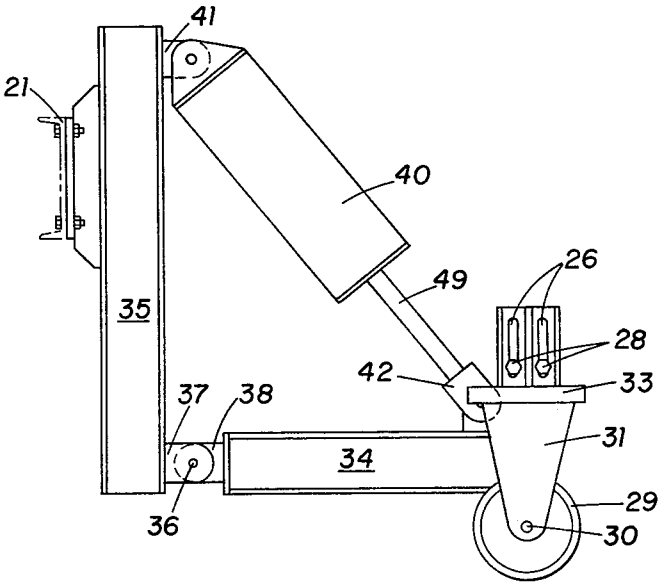
FIG. 4 is a close-up side view of the spray bar assembly.

FIGS. 3, 4, and 5 further illustrate a preferred embodiment of means for attaching the spraying manifold 11 to the truck 2 while also preventing any ground interference between the low projecting spray nozzles and irregularities in the cleaned surface such as dips, bumps, and discontinuities.

The spray manifold 11 is suspended from a cross frame support beam 20 extending parallel to the front bumper 21 of truck 2. Manifold 11 is supported by U-bolts 17 as previously described.

Cross frame 20 has vertical web members 22 and 23 permanently affixed at each end thereof. Each web member 23 presents a flat surface 16 normal to the longitudinal axis of beam 20.

Handle 18 is permanently attached to manifold 11 as previously described, such as by welding. Protractor scale 19 is permanently affixed to beam 20 in close sliding contact to handle 18 to provide a measuring means for controlling the amount of rotation of manifold 11 with respect to beam 20. A tension bolt and nut 24 pass through a hole in handle 18 and a curved slot in scale 19 to allow handle 18 to be clamped tight and prevent further rotation of manifold 11 after the proper spray impingement angle has been achieved.

The flat surfaces 16 each abut a short vertical wheel support beam 25 having vertical slots 26 therethrough. Web member 23 has holes 27 bored therethrough in lateral alignment with slots 26 to receive wheel adjustment bolts 28.

Bolts 28 pass through holes 27 and slots 26 and provide means for adjusting the vertical height of wheels 29 which are rotatably attached to beams 25 by means of roller pins 30 passing through wheel yoke 31, which yoke is fixedly attached to outer web plates 32 and 33. These plates in turn are fixedly secured to vertical wheel beams 25.

The standoff distance, D, can be varied by loosening bolts 28 and moving upward or downward the wheel assemblies comprising wheels 29, pins 30, plates 32 and 33, and vertical beam 25. A common carpenter's level may be used on beam 20 to make certain that the wheels on each side are at the same height, or graduations can be formed on members 23 and 25 in order to obtain the same result.

The spraying assembly can also be adapted for raising or lowering by automatic controls should it become imperative for the spray truck 2 and tank truck to negotiate rough terrain, for instance if an emergency use of the runway or roadway requires hasty removal of the cleaning equipment.

This adaptation involves a pinned rotatable connection of the lateral spray bar support beams 34 to the vertical bumper attachment beams 35 by means of pins 36. Arms 37 of beams 35 extend laterally forward in close proximity to rearward extending arms 38 on beams 34. Pins 36 pass through holes in arms 37 and 38 thereby providing the rotatable connection.

Suspension and placement of the spray assembly comprising manifold 11, spray nozzles 12, beams 20, beams 34, and the two wheel assemblies, is achieved through the use of dual air cylinders 39 and 40.

Each air cylinder 39 or 40 is pinned in rotatable connection to an arm 41 extending forward of beam 35 and has at the lower extending rod end a yoke connector 42 fixedly attached thereto. Yoke connectors 42 are pinned to rearwardly extending arms 43 by pins 44. Arms 43 are permanently attached to the top surfaces of lateral beams 34.

Operation of air cylinders 39 and 40 serve to raise the spray assembly for rapid transit of the spray truck over rough areas, dips, bumps, and discontinuities. A four-way valve located in the cab of truck 2 and connected to cylinders 39 and 40 by air lines 45, 46, 47, 48, and 58 allows the truck operator to remotely control the raising or lowering of the spray assembly as the air cylinders are dual action cylinders and provide positive actuation in both directions. Thus the 4-way valve allows air to be directed through line 58 to the upper side of the cylinders via air lines 45 and 46 to provide downward reacting force on the spray assembly and hold it firmly in contact with the surface being cleaned by holding wheels 29 firmly against the ground. This aids in keeping the proper standoff distance at all times between the nozzles and the surface being cleaned.

Then, when the operator is ready to move off the roadway or runway, for instance when the job is completed or in case of an emergency, the four-way valve can be actuated which moves the high pressure air to the opposite ends of cylinders 39 and 40, thus drawing in connecting rods 49 and pulling the spraying assembly up into a retracted position.

Use of flexible hose 10 supplying high pressure fluid to the spraying manifold 11 and using flexible air lines 58, and 45 through 48, further facilitates the easy movement of the spraying assembly up and down as described above.

The air cylinders further provide a force tending to push the spray assembly downward, offsetting the forces arising from the back reaction of the force of the water sprays acting upward.

Attachment of the spray assembly to the front bumper 21 of the spray truck 2 is achieved by the use of a flat beam 50 welded to a flat plate 51. Plate 51 is bolted directly to the truck bumper 21 and beam 50 can be bolted to vertical beams 35.

Figure 7:
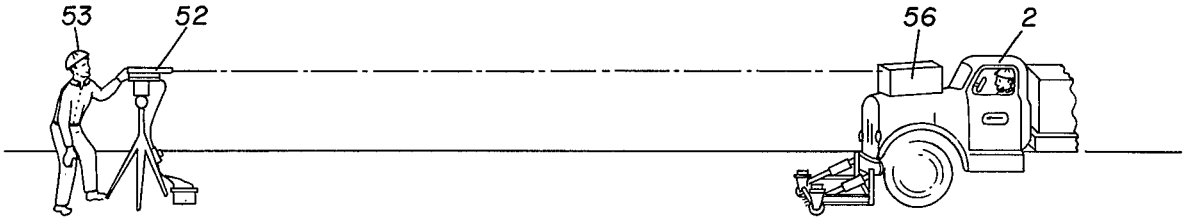
FIGS. 7 and 7*a* illustrate the spray truck guidance system.
Figure 7A:
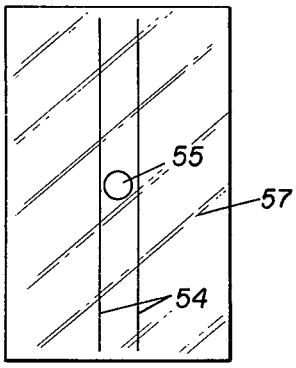

FIG. 7 illustrates a schematic drawing of the sighting and guiding system used to direct the truck mounted system along a substantially straight track to prevent wasteful and inefficient overlap of spray paths as well as preventing gaps of uncleaned surfaces between the spray paths.

In FIG. 7, the spray truck 2 containing the spraying system described above including the spraying manifold 11, is shown progressing along the roadway or runway being cleaned.

A surveyor's transit 52 with a laser beam light source 59 attached thereto is placed at the end of the runway and aimed down the surface in the line of sight along which it is desired to clean. Sighting is accomplished through the transit 52 which may have a crosshair and magnifying features. The laser light instrument 59 is placed in close parallel proximity to the transit so that the laser beam follows approximately the line of sight of the transit. A target may be set up at the opposite end to sight in on or the sight mark on the windshield of truck 2 may be sighted in on.

Use of the transit allows the operator 53 on the ground to place the beam in the proper location prior to beginning the cleaning, much the same way a telescopic sight allows a shooter to place the trajectory of a projectile along a known flight path to a target.

The target in this instance is a pair of parallel marks 54 on the truck windshield and, after the laser beam is pinpointed between these two marks by use of the transit, the operator of the truck can drive the truck down the roadway in a relatively straight line by keeping the beam spot 55 on the windshield always located between the two parallel marks. This achieves a straight-line spray pattern with variations of less than two inches down a 1200 foot runway.

An additional aid to the visibility of the spot utilizes a shadow box 56 mounted on the hood of truck 2 to shield the laser beam and spot from bright sunlight. A piece of clear or translucent glass or plastic 57 may be placed in or near the middle of the box 56 and the two marks 54 placed thereon.

TYPICAL OPERATION

In typical operation the truck 2 and tank truck 5 are driven onto the runway or roadway and positioned at the corner of the area to be cleaned, which is usually an elongated rectangular area. Conduit 7 is connected from the tank 6 to the intake manifold of the pumping assembly.

The proposed line of spraying is established along the runway and the transit-laser beam system is placed at the opposite end of the runway from the trucks and cleaning apparatus. Preferably the height of the transit and laser generating device is set at approximately the same distance as the height of the guidance marks 54 on the spray truck to reduce the need for readjustment of the laser beam height as the cleaning apparatus progresses down the runway. A vertical adjustment on the transit is available to keep the beam on target to compensate for undulating surfaces.

The high pressure pumps are started and the flow valves 13 are opened. Water is forced through nozzles 12 at "high" pressures (pressures in the range of 200 to 20,000 pounds per square inch) with a preferable pressure of around 6,000 pounds per square inch. The nozzles preferably have orifice diameters of about 0.010 to 0.40 inches with what appears to be an optimum orifice size of about 0.040 inches. The spray manifold 11 can be about 8 to 9 feet long and preferably will carry about 100 fan-tail spray nozzles therein. Standoff distance should be around 1 to 2 inches and spray impingement should be around 25° to 45° from vertical.

As the spray begins, the trucks 2 and 5 begin movement down the runway moving in a straight line with the assistance of the laser guidance system at a linear velocity of approximately 1 to 10 miles per hour and preferably around 2 to 4 miles per hour, depending upon the amount of contaminants deposited on the surface and the tenacity of the contaminants in sticking to the surface.

Although water is a desirable fluid to use as a cleaning agent, this may be supplemented by adding mild detergents or solvents to it. Furthermore, other liquids than water can be utilized.

This process is repeated along adjacent strips of the runway until the entire surface is cleaned.

Although a specific preferred embodiment of the present invention has been described in the detailed description above, the description is not intended to limit the invention to the particular forms or embodiments disclosed herein, since they are to be recognized as illustrative rather than restrictive and it will be obvious to those skilled in the art that the invention is not so limited. For example, many configurations of spray bars could be utilized, including curved bars or a multiplicity of bars either in parallel or above one another. Other guiding systems could be used, including a stretched rope, string, or wire, or a painted reference line on the surface to be cleaned. A further guidance system might utilize radar or sonar guidance devices. The tank truck could also be replaced by locating water storage containers on the spray truck. Also, it is possible to utilize long water supply hoses reaching from water hydrants near the runway to the spray truck instead of using tank means. Thus the invention is declared to cover all changes and modifications of the specific example of the invention herein disclosed for purposes of illustration, which do not constitute departures from the spirit and scope of the invention.

What is claimed is:

1. An apparatus for high pressure hydrocleaning of large planar surfaces, which comprises:

a. an elongated tubular high pressure manifold having a horizontal longitudinal axis and two ends;

b. a plurality of spray nozzles attached in a linear pattern to and fluidly communicating with said manifold;

c. means for rotating said manifold about said longitudinal axis while measuring the angle of such rotation;

d. means for transporting said manifold along the planar surface;

e. means for mounting said manifold on said transporting means;

f. means for highly pressurizing water and communicating highly pressurized water to said spray nozzles; and g. means, communicating with said pressurizing means, for supplying large quantities of water thereto.

2. The apparatus of claim 1, further comprising:

means for controllably counterbalancing, with fluid pressure, said manifold against forces upon said manifold due to emittance of spray by said spray nozzles.

3. The apparatus of claim 2 wherein the spray nozzles are fan-tail nozzles.

4. The apparatus of claim 1 further comprising:

laser beam guidance means for guiding said transporting means along said planar surface.

5. An apparatus for high pressure hydrocleaning of large planar surfaces, which comprises:

a. an elongated tubular high pressure manifold having a horizontal longitudinal axis and two ends;

b. a plurality of spray nozzles attached in a linear pattern to and fluidly communicating with said manifold;

c. means for transporting said manifolding along the planar surface;

d. means for mounting said manifold on said transporting means, said manifold being located, when mounted, at an angle to said transporting means and substantially parallel to said surface being cleaned, said angle varying from 0° up to 55°;

e. means for highly pressurizing water and communicating highly pressurized water to said spray nozzles; and f. means, communicating with said pressurizing means, for supplying large quantities of water thereto.

6. The apparatus of claim 5, further comprising:

fluid pressure means for controllably counterbalancing any reactive forces of said spray nozzles upon said manifold and for quickly raising and lowering said manifold relative to the planar surface in response to a remote signal.

7. The apparatus of claim 5 wherein said manifold is an angular elongated section of tubing having an included angle of from about 10° up to about 55°.

8. The apparatus of claim 2 wherein said manifold is an elongated curved section of tubular material.

9. The apparatus of claim 8, wherein:

said laser beam guidance means includes a surveyor's transit, a laser beam light source atop said transit, and a shadow box mounted on said transporting means, said shadow box having mark means placed therein for aligning said vehicle with a laser beam produced by said laser beam source and directed at said transporting means.

10. An apparatus for high pressure hydrocleaning of large planar surfaces, which comprises:

a. an elongated tubular high pressure manifold having a horizontal longitudinal axis and two ends;

b. a multiplicity of spray nozzles attached in a linear arrangement to and fluidly communicating with said manifold, said nozzles having a bore along their longitudinal axis and said nozzles further have a fan-tail portion arranged to flatten out the high pressure fluid spray emitted from said bore, said fan-tail portion arranged to alter the direction of spray from said bore, said angle of alteration being from about 5° up to about 90°;

c. means for transporting said manifold along the planar surface;

d. means for mounting said manifold on said transporting means;

e. means for highly pressurizing water and communicating highly pressurized water to said spray nozzles; and f. means, communicating with said pressurizing means, for supplying large quantities of water thereto.

11. The apparatus of claim 9 wherein said bore has an opening of from about 0.010 inches up to about 0.40 inches.

12. The apparatus of claim 10 wherein said wheel means further comprises adjustment means having adjustable attachment means for attaching said wheel means to said mounting means whereby said standoff distance between said spray means and said surface being cleaned may be varied from about one-fourth inch up to about 6 inches.

13. The apparatus of claim 9 further comprising means for counterbalancing said manifold against reactive forces thereon due to the action of said spray nozzles when said spray nozzles emit fluid spray.

14. The apparatus of claim 12 wherein said counterbalancing means comprises at least one pneumatic cylinder attached between said mounting means and said transporting means, and swivel connection means between said mounting means and said transporting means, said pneumatic cylinder adapted to raise and lower said spray means.

15. The apparatus of claim 12 wherein said counterbalancing means comprises at least one hydraulic cylinder attached between said mounting means and said transporting means, and swivel connection means between said mounting means and said transporting means, said pneumatic cylinder adapted to raise and lower spray means.

16. The apparatus of claim 9 further comprising:

laser beam guidance means for guiding said transporting means along said planar surface.

17. Apparatus for high pressure hydrocleaning of large planar surfaces, which comprises:

a. a mobile high pressure pump;

b. a large volume mobile tank;

c. a low pressure conduit fluidly connecting said pump to said tank;

d. a spray system comprising:

1. a carrier attached to said mobile pump;
2. a spray manifold mounted on said carrier;
3. a plurality of fan-tail spray nozzles located on said spray manifold and fluidly communicating with said spray manifold; and
4. fluid pressure means for controllably counterbalancing any reactive forces of said spray nozzles upon said manifold;
5. means for rotating said manifold about its longitudinal axis; and
6. means for measuring the angle of such rotation relative to a given position;

e. a high pressure conduit fluidly connecting said pump to said spray manifold; and f. at least one valve in at least one of said conduits.

18. The apparatus of claim 16, further comprising:

a. means for preventing dragging of said low pressure conduit along the planar surface during movement of either the mobile pump or mobile tank; and b. means for preventing dragging of said high pressure conduit along the planar surface.

19. The apparatus of claim 16, further comprising:

a. movable connection means, in said carrier, to allow raising and lowering of the front portion of said carrier containing said manifold; and b. power means to raise and lower said carrier front portion quickly and in response to actuation from a remote location, said power means being rotatably attached to said carrier front portion and the remainder of said carrier.

20. The apparatus of claim 16 further comprising laser beam guidance means for guiding said cleaning apparatus down said runway and roadway surfaces.

21. The apparatus of claim 16 further comprising:

laser beam guidance means for guiding said transporting means along said planar surface.

22. Apparatus for hydrocleaning large planar surfaces, said apparatus comprising:

a. mobile pressurizing means containing high pressure pumping means;

b. mobile tank means having the capacity for carrying large volumes of fluids;

c. conduit means fluidly connecting said pumping means to said tank means;

d. spray means on said mobile pressurizing means, said spray means comprising:
   1. carrier means attached to said mobile pressurizing means;
   2. spray manifold means mounted on said carrier means; and
   3. a plurality of spray nozzles located on said spray manifold means and communicating fluidly with said spray manifold means;

e. high pressure conduit means fluidly connecting said pumping means to said spray manifold means;

f. valve means in said conduit means; and g. guidance means for guiding said hydrocleaning apparatus along said planar surface, wherein said guidance means includes laser beam generating means, transit means attached to said laser beam generating means and aimed in substantially parallel relationship to the laser beam emitted by said laser beam generating means, and target means on said cleaning apparatus for receiving said laser beam and indicating alignment with said laser beam.

* * * * *

UNITED STATES PATENT AND TRADEMARK OFFICE

CERTIFICATE OF CORRECTION

PATENT NO. : 3,987,964

DATED : October 26, 1976

INVENTOR(S) : Forrest C. Pittman, et al

It is certified that error appears in the above-identified patent and that said Letters Patent are hereby corrected as shown below:

On the first page after "Inventors:" delete the names of "Carlos E. Gutierrez, Marvin L. Klein and William F. White"

Signed and Sealed this

Seventeenth Day of May 1977

[SEAL]

*Attest:*

RUTH C. MASON
*Attesting Officer*

C. MARSHALL DANN
*Commissioner of Patents and Trademarks*